US011101097B2

(12) United States Patent
Ponard

(10) Patent No.: US 11,101,097 B2
(45) Date of Patent: Aug. 24, 2021

(54) COMPACT SOURCE FOR GENERATING IONIZING RADIATION, ASSEMBLY COMPRISING A PLURALITY OF SOURCES AND PROCESS FOR PRODUCING THE SOURCE

(71) Applicant: THALES, Courbevoie (FR)

(72) Inventor: Pascal Ponard, Neuvecelle (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 16/610,879

(22) PCT Filed: Jul. 11, 2018

(86) PCT No.: PCT/EP2018/068811
§ 371 (c)(1),
(2) Date: Nov. 4, 2019

(87) PCT Pub. No.: WO2019/011993
PCT Pub. Date: Jan. 17, 2019

(65) Prior Publication Data

US 2021/0142974 A1 May 13, 2021

(30) Foreign Application Priority Data

Jul. 11, 2017 (FR) ..... 1700742

(51) Int. Cl.
*H01J 35/16* (2006.01)
*H01J 35/06* (2006.01)
*H01J 35/18* (2006.01)

(52) U.S. Cl.
CPC ..... *H01J 35/165* (2013.01); *H01J 35/066* (2019.05); *H01J 35/064* (2019.05); *H01J 35/186* (2019.05); *H01J 2235/023* (2013.01)

(58) Field of Classification Search
CPC ..... H01J 35/064; H01J 35/186; H01J 35/165; H01J 2235/023; H01J 35/066
See application file for complete search history.

(56) References Cited

U.S. PATENT DOCUMENTS 5,854,822 A 12/1998 Chornenky et al.
6,351,520 B1 * 2/2002 Inazaru ..... H01J 35/14 378/138
2002/0090053 A1 7/2002 Chornenky et al.

FOREIGN PATENT DOCUMENTS

EP 0 063 840 A1 11/1982
EP 3 016 129 A1 5/2016
WO 2006/063982 A1 6/2006

* cited by examiner

*Primary Examiner* — Chih-Cheng Kao
(74) *Attorney, Agent, or Firm* — BakerHostetler

(57) ABSTRACT

A source for generating ionizing radiation and in particular x-rays, to an assembly includes a plurality of sources and to a process for producing the source. The source comprises: a vacuum chamber; a cathode that is able to emit an electron beam into the chamber; an anode that receives the electron beam and that comprises a target that is able to generate ionizing radiation from the energy received from the electron beam; an electrode that is placed in the vicinity of the cathode and that allows the electron beam to be focused; a stopper ensuring the seal tightness of the vacuum chamber; and a mechanical part that is made of dielectric and that forms a portion of the vacuum chamber; and the stopper is fastened to the mechanical part by means of a conductive brazing film that is used to electrically connect the electrode.

10 Claims, 11 Drawing Sheets

COMPACT SOURCE FOR GENERATING IONIZING RADIATION, ASSEMBLY COMPRISING A PLURALITY OF SOURCES AND PROCESS FOR PRODUCING THE SOURCE

CROSS-REFERENCE TO RELATED APPLICATIONS

This application is a National Stage of International patent application PCT/EP2018/068811, filed on Jul. 11, 2018, which claims priority to foreign French patent application No. FR 1700742, filed on Jul. 11, 2017, the disclosures of which are incorporated by reference in their entirety.

FIELD OF THE INVENTION

The invention relates to a source for generating ionizing radiation and in particular x-rays, to an assembly comprising a plurality of sources and to a process for producing the source.

BACKGROUND

At the present time, x-rays have many uses in particular in imaging and in radiotherapy. X-ray imaging is widely employed in particular in the medical field, in industry to perform nondestructive tests and in the security field to detect dangerous materials or objects.

The production of images from x-rays has progressed a lot. Originally only photosensitive films were used. Since, digital detectors have appeared. These detectors, associated with software packages, allow two-dimensional or three-dimensional images to be rapidly reconstructed by means of scanners.

In contrast, since the discovery of x-rays by Röntgen in 1895, x-ray generators have changed very little. Synchrotrons, which appeared after the Second World War, allow an intense and well-focused emission to be generated. The emission is due to acceleration or deceleration of charged particles, which optionally move in a magnetic field.

Linear accelerators and x-ray tubes implement an accelerated electron beam that bombards a target. The deceleration of the beam due to the electric fields of the nuclei of the target allow bremsstrahlung x-rays to be generated.

An x-ray tube generally consists of an envelope in which a vacuum is produced. The envelope is formed from a metal structure and an electrical insulator normally made of alumina or glass. Two electrodes are placed in this envelope. A cathodic electrode, biased to a negative potential, is equipped with an electron emitter. An anodic second electrode, biased to a positive potential with respect to the first electrode, is associated with a target. Electrons accelerated by the potential difference between the two electrodes produce a continuous spectrum of ionizing radiation by deceleration (bremsstrahlung) when they strike the target. The metal electrodes are necessarily of large size and possess large radii of curvature in order to minimize the electric fields on the surface.

Depending on the power of the x-ray tube, the latter may be equipped either with a stationary anode or with a rotating anode that makes it possible to spread the thermal power. Stationary-anode tubes have a power of a few kilowatts and are in particular used in low-power medical, safety and industrial applications. Rotating-anode tubes may exceed 100 kilowatts and are mainly employed in the medical field for imaging requiring a high x-ray flux allowing contrast to be improved. By way of example, the diameter of an industrial tube is about 150 mm at 450 kV, about 100 mm at 220 kV and about 80 mm at 160 kV. The indicated voltage corresponds to the potential difference applied between the two electrodes. For medical rotating-anode tubes, the diameter varies from 150 to 300 mm depending on the power to be dissipated on the anode.

The dimensions of known x-ray tubes therefore remain large, of the order of several hundred mm. Imaging systems have seen the appearance of digital detectors with increasingly rapid and high-performance 3-D reconstruction software packages whereas, at the same time, x-ray tube technologies have remained practically unchanged for a century, and this is a major technological limitation on x-ray imaging systems.

Several factors are an obstacle to the miniaturization of current x-ray tubes.

The dimensions of the electrical insulators must be large enough to guarantee a good electrical insulation with respect to high voltages of 30 kV to 300 kV. Sintered alumina, which is often used to produce these insulators, typically has a dielectric strength of about 18 MV/m.

The radius of curvature of the metal electrodes must not be too small in order to keep the static electric field applied to the surface below an acceptable limit, typically 25 MV/m. Thereabove, the emission of parasitic electrons via a tunneling effect becomes difficult to control and leads to heating of walls, to the emission of undesirable x-rays and to micro-discharges. Thus, at high voltages, such as encountered in x-ray tubes, the dimensions of the cathodic electrodes are large in order to limit parasitic emission of electrons.

Thermionic cathodes are often used in conventional tubes. The dimensions of this type of cathode and their operating temperature, typically above 1000° C., lead to expansion problems and to the evaporation of electrically conductive elements such as barium. This makes miniaturization and integration of this type of cathode in contact with a dielectric insulator difficult.

Surface charge effects related to the coulomb interaction appear on the surface of the dielectrics (alumina or glass) used when this surface is in the vicinity of an electron beam. In order to prevent proximity between the electron beam and the dielectric surfaces, either an electrostatic shield is formed using a metal screen placed in front of the dielectric, or the distance between the electric beam and the dielectric is increased. The presence of screens or this increased distance also tends to increase the dimensions of x-ray tubes.

The anode forming the target must dissipate a high thermal power. This dissipation may be achieved with a flow of heat-transfer fluid or by producing a rotating anode of large size. The need for this dissipation also requires the dimensions of x-ray tubes to be increased.

Among emerging technological solutions, the literature describes the use of carbon-nanotube-based cold cathodes in x-ray tube structures, but currently proposed solutions remain based on conventional x-ray tube structures implementing a metal wehnelt encircling the cold cathode. This wehnelt is an electrode raised to a high voltage and is always subject to severe dimensional constraints, with regard to limiting the parasitic emission of electrons.

SUMMARY OF THE INVENTION

The invention aims to mitigate all or some of the aforementioned problems by providing a source of ionizing radiation, for example taking the form of a high-voltage triode or diode, the dimensions of which are much smaller than those of conventional x-ray tubes. The mechanism of generation of the ionizing radiation remains similar to that implemented in known tubes, namely an electron beam bombarding a target. The electron beam is accelerated between a cathode and an anode between which a potential difference, for example higher than 100 kV, is applied. For a given potential difference, the invention allows the dimensions of the source according to the invention to be substantially decreased with respect to known tubes.

To achieve this aim, the invention provides a source of ionizing radiation comprising a vacuum chamber in which a stopper performs a number of functions.

More precisely, one subject of the invention is a source for generating ionizing radiation, comprising:

- a vacuum chamber;
- a cathode that is able to emit an electron beam into the chamber;
- an anode that receives the electron beam and that comprises a target that is able to generate ionizing radiation from the energy received from the electron beam;
- an electrode that is placed in the vicinity of the cathode and that allows the electron beam to be focused;
- a stopper ensuring the seal tightness of the vacuum chamber; and a mechanical part that is made of dielectric and that forms a portion of the vacuum chamber; and the stopper is fastened to the mechanical part by means of a conductive brazing film that is used to electrically connect the electrode.

Advantageously, the stopper is made from the same dielectric as the mechanical part.

The brazing film is advantageously axisymmetric about an axis of the electron beam and forms with the electrode an equipotential assembly.

The stopper advantageously comprises at least one electrical connection passing therethrough, allowing a means for controlling the cathode to be electrically connected, and biased to a different potential to the brazing film.

The stopper advantageously forms a coaxial transmission line, the electrical connection passing through the stopper forming a central conductor of the coaxial line and the brazing film of the stopper forming a shield of the coaxial line.

The stopper advantageously comprises a surface exterior to the vacuum chamber. The exterior surface then comprises a plurality of separate zones that are metallized separately. At least one of these zones makes electrical contact with the at least one electrical connection and another of these zones makes electrical contact with the brazing film, in order to ensure the electrical connection of the cathode and of the electrode by way of the at least one electrical connection and of the brazing film.

Advantageously, the source comprises a coaxial connector connected to the brazing film and to the at least one electrical connection, and a cavity located between the coaxial connector and the stopper, the cavity being shielded from a main electric field of the source.

Advantageously, the mechanical part comprises a surface exterior to the vacuum chamber having an interior frustoconical shape that flares from the external surface of the stopper. The source furthermore comprises a holder having a surface that is complementary to the interior frustoconical shape of the mechanical part. The complementary surface and the interior frustoconical shape are then configured to convey air trapped between the complementary surface and the interior frustoconical shape when the mechanical part is mounted in the holder toward the cavity.

Advantageously, the cathode emits the electron beam via a field effect and the means for controlling the cathode comprise an optoelectronic component that is electrically connected via the electrical connection passing through the stopper.

Advantageously, the mechanical part comprises a cavity in which the cathode is placed. A getter is placed in the cavity, between the cathode and the stopper.

BRIEF DESCRIPTION OF THE DRAWINGS

The invention will be better understood and other advantages will become apparent on reading the detailed description of one embodiment that is given by way of example, which description is illustrated by the appended drawing, in which.

For the sake of clarity, elements that are the same have been given the same references in the various figures.

DETAILED DESCRIPTION

Figure 1:
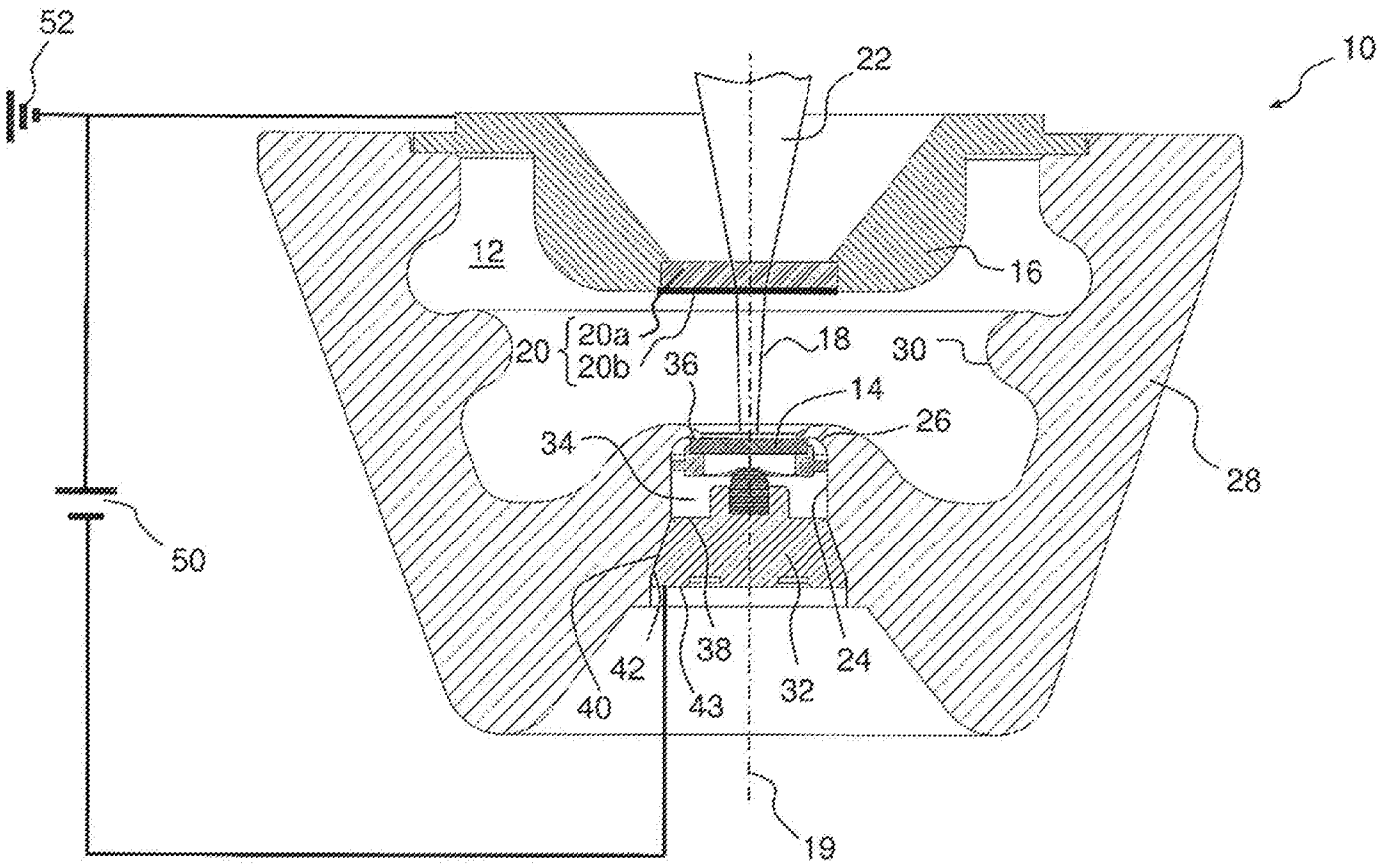
FIG. 1 schematically shows the main elements of an x-ray generating source according to the invention.

FIG. 1 shows in cross section an x-ray generating source 10. The source 10 comprises a vacuum chamber 12 in which a cathode 14 and an anode 16 are placed. The cathode 14 is intended to emit an electron beam 18 into the chamber 12 in the direction of the anode 16. The anode 16 comprises a target 20 that is bombarded by the beam 18 and that, depending on the energy of the electron beam 18, emits x-rays 22. The beam 18 is generated about an axis 19 passing through the cathode 14 and the anode 16.

X-ray generating tubes conventionally employ a thermionic cathode operating at a high temperature, typically about 1000° C. This type of cathode is commonly called a hot cathode. This type of cathode is composed of a metal or metal-oxide matrix that emits an electron flux that is caused by vibrations of atoms due to the high temperature. However, hot cathodes suffer from a plurality of drawbacks, such as a slow dynamic response of the current to control, related to the time constants of the thermal processes, and such as the need to use, to control the current, grids located between the cathode and the anode and biased to high voltages. These grids are thus located in a zone of very high electric field, and they are subjected to high operating temperatures of about 1000° C. All of these constraints greatly limit the options with regard to integration and lead to electron guns of large size.

More recently, cathodes employing a field-emission mechanism have been developed. These cathodes operate at room temperature and are commonly called cold cathodes. They for the most part consist of a conductive planar surface equipped with relief structures, on which an electric field is concentrated. These relief structures emit electrons when the field at the tip is sufficiently high. The relief emitters may be formed from carbon nanotubes. Such emitters are for example described in the patent application published under the number WO 2006/063982 A1 and filed in the name of the applicant. Cold cathodes do not have the drawbacks of hot cathodes and are above all much more compact. In the example shown, the cathode 14 is a cold cathode and therefore emits the electron beam 18 via a field effect. The means for controlling the cathode 14 are not shown in FIG. 1. The cathode may be controlled electrically or optically as also described in document WO 2006/063982 A1.

Under the effect of a potential difference between the cathode 14 and the anode 16, the electron beam 18 is accelerated and strikes the target 20, which for example comprises a membrane 20*a*, which is for example made of diamond or beryllium coated with a thin layer 20*b* made from an alloy based on a material of high atomic number such as, in particular, tungsten or molybdenum. The layer 20*b* may have a variable thickness that is for example, depending on the energy of the electrons of the beam 18, comprised between 1 and 12 μm. The interaction between the electrons of the electron beam 18, which electrons are accelerated to high speed, and the material of the thin layer 20*b* allows x-rays 22 to be produced. In the example shown, the target 20 advantageously forms a window of the vacuum chamber 12. In other words, the target 20 forms a portion of the wall of the vacuum chamber 12. This arrangement is in particular implemented for a target operating in transmission. For this arrangement, the membrane 20*a* is formed from a material of low atomic number, such as diamond or beryllium, for its transparency to x-rays 22. The membrane 20*a* is configured to ensure, with the anode 16, the vacuum tightness of the chamber 12.

Alternatively, the target 20, or at the very least the layer made from a high-atomic-number alloy, may be entirely placed in the interior of the vacuum chamber 12, the x-rays then exiting from the chamber 12 by passing through a window forming a portion of the wall of the vacuum chamber 12. This arrangement is in particular implemented for a target operating in reflection. The target is then separate from the window. The layer in which the x-rays are produced may be thick. The target may be stationary or rotate so as to allow the thermal power generated during the interaction with the electrons of the beam 18 to be spread.

Advantageously, it is possible for a severe constraint on the electric-field level at the surface of the cathodic electrode or wehnelt to be relaxed. This constraint is related to the metal nature of the interface between the electrode and the vacuum present in the chamber through which the electron beam propagates. Specifically, the metal/vacuum interface of the electrode is replaced with a dielectric/vacuum interface that does not allow parasitic emission of electrons via a tunneling effect. It is then possible to accept much higher electric fields than those acceptable with a metal/vacuum interface. Initial internal trials have shown that it is possible to achieve static fields much higher than 30 MV/m without parasitic emission of electrons. This dielectric/vacuum interface may, for example, be obtained by replacing the metal electrode, the external surface of which is subjected to the electric field, with an electrode consisting of a dielectric the external surface of which is subjected to the electric field and the internal surface of which is coated with a perfectly adherent conductive deposit performing the electrostatic wehnelt function. It is also possible to cover the external surface of a metal electrode subjected to the electric field with a dielectric in order to replace the metal/vacuum interface of known electrodes with a dielectric/vacuum interface, there where the electric field is high. This arrangement in particular allows the maximum electric field below which parasitic emission of electrons does not occur to be increased.

The increase in the permissible electric fields allows x-ray sources, and more generally sources of ionizing radiation, to be miniaturized.

To this end the source 10 comprises an electrode 24 that is placed in the vicinity of the cathode 14 and that allows the electron beam 18 to be focused. The electrode 24 forms a wehnelt. In the case of what is called a cold cathode, the electrode 24 is placed in contact with the cathode. A cold cathode emits an electron beam via a field effect. This type of cathode is for example described in document WO 2006/063982 A1 filed in the name of the applicant. In the case of a cold cathode, the electrode 24 is placed in contact with the cathode 14. The mechanical part 28 advantageously forms a holder of the cathode 14. To perform the wehnelt function, the electrode 24 has an essentially convex shape. The exterior of the concavity of the face 26 is oriented toward the anode 16. Locally, where the cathode 14 and the electrode make contact, the convexity of the electrode 24 may be zero or slightly inverted.

The electrode 24 is formed from a continuous conductive area placed on a concave face 26 of a dielectric. The concave face 26 of the dielectric forms a convex face of the electrode 24 facing the anode 16. It is on this convex face of the electrode 24 that high electric fields develop. In the prior art, a metal-vacuum interface existed on this convex face of the electrode. Therefore, it was possible for this interface to be the seat of emission of electrons under the effect of the electric field in the interior of the vacuum chamber. This interface of the electrode with the vacuum of the chamber is removed and replaced with a dielectric/vacuum interface. A dielectric, since it contains no free charge, cannot therefore be the seat of a sustained emission of electrons.

It is important to prevent an air-filled or vacuum cavity from forming between the electrode 24 and the concave face 26 of the dielectric. Specifically, in case of an uncertain contact between the electrode 24 and the dielectric, the electric field could be very highly amplified at the interface and electron emission could occur or a plasma could be generated there. For this reason, the source 10 comprises a mechanical part 28 made from the dielectric. One of the faces of the mechanical part 28 is the concave face 26. In this case, the electrode 24 consists of a deposit of a conductor that adheres perfectly to the concave face 26. Various techniques may be employed to produce this deposit, such as in particular physical vapor deposition (PVD) or chemical vapor deposition (CVD) that is optionally plasma-enhanced (PECVD).

Alternatively, it is possible to produce a deposit of dielectric on the surface of a bulk metal electrode. The dielectric deposit, which adheres to the bulk metal electrode, again allows an air-filled or vacuum cavity to be avoided at the electrode/dielectric interface. This dielectric deposit is chosen to withstand high electric fields, typically higher than 30 MV/m, and to possess a sufficient suppleness compatible with potential thermal expansion of the bulk metal electrode. However, the inverse arrangement, implementing the deposition of a conductor on the internal face of a bulk part made of dielectric has other advantages, in particular that of allowing the mechanical part 28 to be used to perform other functions.

More precisely, the mechanical part 28 may form a portion of the vacuum chamber 12. This portion of the vacuum chamber may even be a preponderant portion of the vacuum chamber 12. In the shown example, the mechanical part 28 forms, on the one hand, a holder of the cathode 14, and, on the other hand, a holder of the anode 16. The part 28 ensures the electrical insulation between the anode 16 and the cathodic electrode 24.

With regard to the production of the mechanical part 28, just using a conventional dielectric, such as for example sintered alumina, allows any metal/vacuum interface to be avoided. However, the dielectric strength of this type of material, about 18 MV/m, still limits miniaturization of the source 10. To further miniaturize the source 10, a dielectric possessing a dielectric strength higher than 20 MV/m and advantageously higher than 30 MV/m is chosen. The value of the dielectric strength for example remains above 30 MV/m in a temperature range comprised between 20 and 200° C. Composite nitride ceramics allow this criterion to be met. Internal trials have shown that one ceramic of this nature even allows 60 MV/m to be exceeded.

On miniaturization of the source 10, surface charges may accumulate on an internal face 30 of the vacuum chamber 12, and in particular on the internal face of the mechanical part 28, when the electron beam 18 is established. It is useful to be able to drain these charges, and for this reason the internal face 30 has a surface resistivity measured at room temperature comprised between $1\times10^{9}\Omega\cdot$square and $1\times10^{13}\Omega\cdot$square and typically in the vicinity of $1\times10^{11}\Omega\cdot$square. Such a resistivity may be obtained by adding to the surface of the dielectric a conductor or semiconductor that is compatible with the dielectric. By way of semiconductor, it is for example possible to deposit silicon on the internal face 30. In order to obtain the right resistivity range, for example for a nitride-based ceramic, it is possible to modify its intrinsic properties by adding thereto a few percent (typically less than 10%) of a powder of titanium nitride, which is known for its low resistivity, of about $4\times10^{-3}\Omega\cdot$m, or of semiconductors such as silicon carbide SiC.

It is possible to disperse the titanium nitride in the volume of the dielectric in order to obtain a uniform resistivity throughout the material of the mechanical part 28. Alternatively, it is possible to obtain a resistivity gradient by diffusing the titanium nitride from the internal face 30 via a high-temperature heat treatment at a temperature above 1500° C.

The source 10 comprises a stopper 32 that ensures the seal tightness of the vacuum chamber 12. The mechanical part 28 comprises a cavity 34 in which the cathode 14 is placed. The cavity 34 is bounded by the concave face 26. The stopper 32 closes the cavity 34. The electrode 24 comprises two ends 36 and 38 that are distant along the axis 19. The first end 36 makes contact with the cathode 14 and is in electrical continuity therewith. The second end 38 is opposite the first. The mechanical part 28 comprises an interior conic frustum 40 of circular cross-section placed about the axis 19 of the beam 18. The conic frustum 40 is located at the second end 38 of the electrode 24. The conic frustum widens with distance from the cathode 14. The stopper 32 has a shape that is complementary to the conic frustum 40 in order to be placed therein. The conic frustum 40 ensures the positioning of the stopper 32 in the mechanical part 28. The stopper 32 may be implemented independently of whether, as in this embodiment, the electrode 24 takes the form of a conductive area placed on the concave face 26 of the dielectric.

Advantageously, the stopper 32 is made from the same dielectric as the mechanical part 28. This allows potential effects of differential thermal expansion between the mechanical part 28 and the stopper 32 during use of the source to be limited.

The stopper 32 is for example fastened to the mechanical part 28 by means of a brazing film 42 produced in the conic frustum 40 and more generally in an interface zone between the stopper 32 and the mechanical part 28. It is possible to metallize the surfaces intended to be brazed of the stopper 32 and of the mechanical part 28, then to carry out the brazing by means of a metal alloy the melting point of which is higher than the maximum temperature of use of the source 10. The metallization and the brazing film 42 are placed in electrical continuity with the end 38 of the electrode 24. The frustoconical shape of the metallized interface between the stopper 32 and the mechanical part 28 allows shapes that are too pronouncedly angular for the electrode 24 and for the conductive zones extending the electrode 24 to be avoided in order to limit potential edge effects on the electric field.

Alternatively, it is possible to avoid the need to metallize the surfaces by incorporating into the brazing alloy an active element that reacts with the material of the stopper 32 and with the material of the mechanical part 28. For nitride-based ceramics, titanium is integrated into the brazing alloy. Titanium is a material that reacts with nitrogen and allows a strong chemical bond to be created with the ceramic. Other reactive metals may be used such as vanadium, niobium or zirconium.

Advantageously, the brazing film 42 is conductive and is used to electrically connect the electrode 24 to a power supply of the source 10. The electrical connection of the electrode 24 by means of the brazing film 42 may be implemented with other types of electrode, in particular metal electrodes covered with a dielectric deposit. To reinforce the connection with the electrode 24, it is possible to embed a metal contact in the brazing film 42. This contact is advantageous for connecting a bulk metal electrode covered with a dielectric deposit. The electrical connection of the electrode 24 is ensured by this electrical contact. Alternatively, it is possible to partially metallize a surface 43 of the stopper 32. The surface 43 is located at the end of the vacuum chamber 12. The metallization of the surface 43 makes electrical contact with the brazing film 42. It is possible to braze on the metallization of the surface 43 a contact that may be electrically connected to a power supply of the source 10.

The brazing film 42 extends the axisymmetric shape of the electrode 24 and thus contributes to the main function of the electrode 24. This is particularly advantageous when the electrode 24 is formed from a conductive area placed on the concave face 26. The brazing film 42 extends the conductive area forming the electrode 24 directly and without discontinuity or angular edges extending away from the axis 19. The electrode 24, which is associated with the brazing film 42 when the latter is conductive, forms an equipotential area that is used to help focus the electron beam 18 and to bias the cathode 14. This allows local electric fields to be minimized with a view to increasing the compactness of the source 10.

The face 26 may contain locally convex zones, such as for example at its junction with the conic frustum 40. In practice, the face 26 is at least partially concave. The face 26 is concave on the whole.

Figure 2:
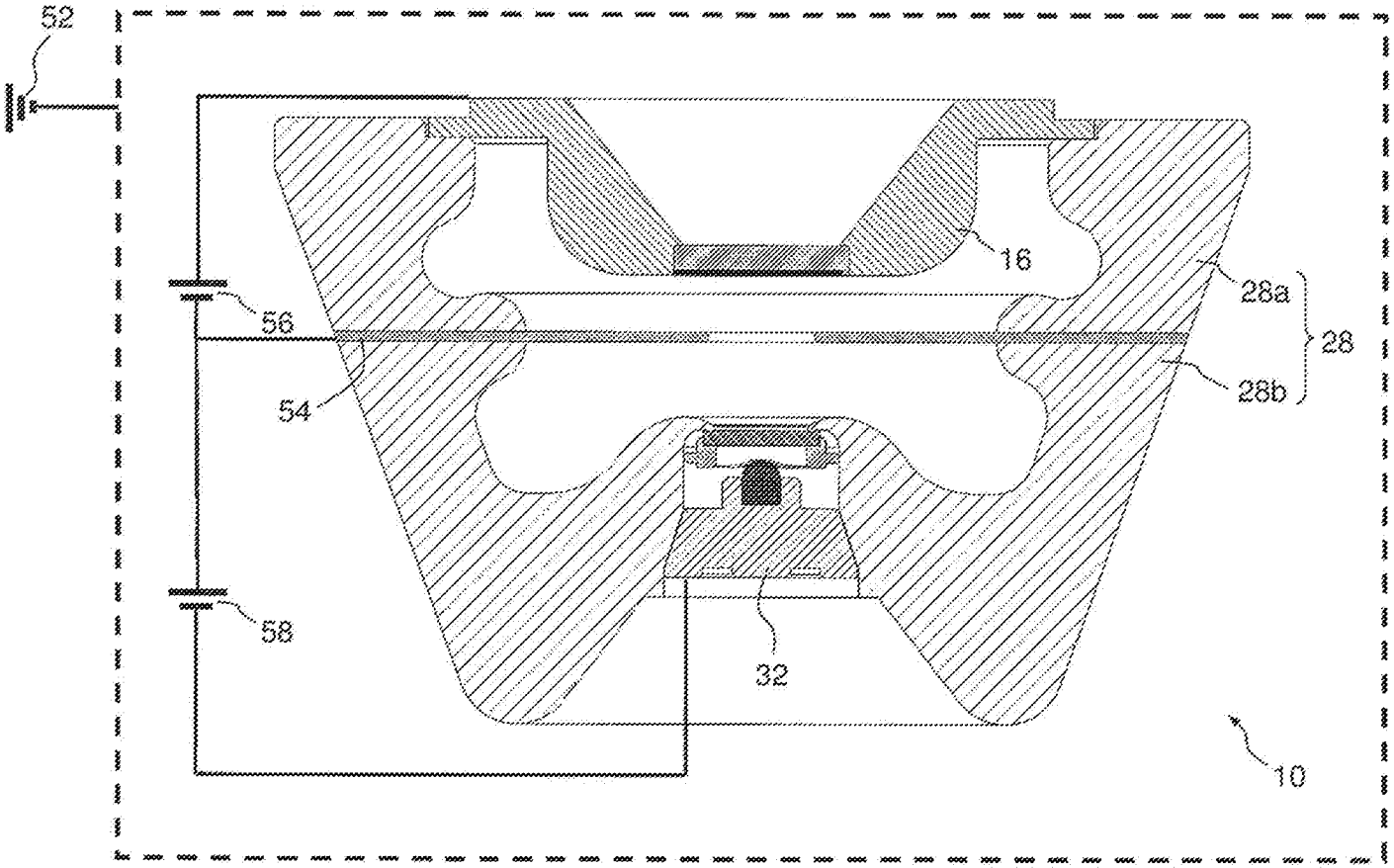
FIG. 2 shows a variant of the source of FIG. 1 allowing other modes of electrical connection.

In FIG. 1, the source 10 is biased by means of high-voltage source 50 a negative terminal of which is connected to the electrode 24, for example by way of the metallization of the brazing film 42, and a positive terminal of which is connected to the anode 16. This type of connection is characteristic of operation of the source 10 in a monopolar mode, in which the anode 16 is connected to ground 52. It is also possible to replace the high-voltage source 50 with two high-voltage sources 56 and 58 in series, in order to make the source 10 operate in a bipolar mode as shown in FIG. 2. This type of operation is advantageous as it simplifies production of the associated high-voltage generator. For example, in the case of a high-voltage, high-frequency, pulsed operating mode, it may be advantageous to lower the absolute voltage by summing two, positive and negative, half voltages at the source 10. For this reason, the high-voltage source may comprise a output transformer driven via a half-H bridge.

With a source 10 such as shown in FIG. 1, a bipolar operating mode may be achieved by connecting the common point of the generators 56 and 58 to ground 52. Alternatively, it is also possible to keep the high-voltage source 50 floating with respect to ground 52 as in FIG. 2.

A bipolar operating mode is achieved with a source such as illustrated in FIG. 1 by keeping the common point of two series-connected high-voltage sources floating. Alternatively, this common point may be used to bias another electrode of the source 10, as shown in FIG. 2. In this variant, the source 10 comprises an intermediate electrode 54 that splits the mechanical part 28 into two portions 28*a* and 28*b*. The intermediate electrode 54 extends perpendicularly to the axis 19 of the beam 18 and is passed through by the beam 18. The presence of the electrode 54 allows a bipolar operating mode to be achieved by connecting the electrode 54 to the common point of the two series-connected high-voltage sources 56 and 58. In FIG. 2, the assembly formed by the two high-voltage sources 56 and 58 is floating with respect to ground 52. As shown in FIG. 1, it is also possible to connect one of the electrodes of the source 10, for example the intermediate electrode 54, to ground 52.

Figure 3:
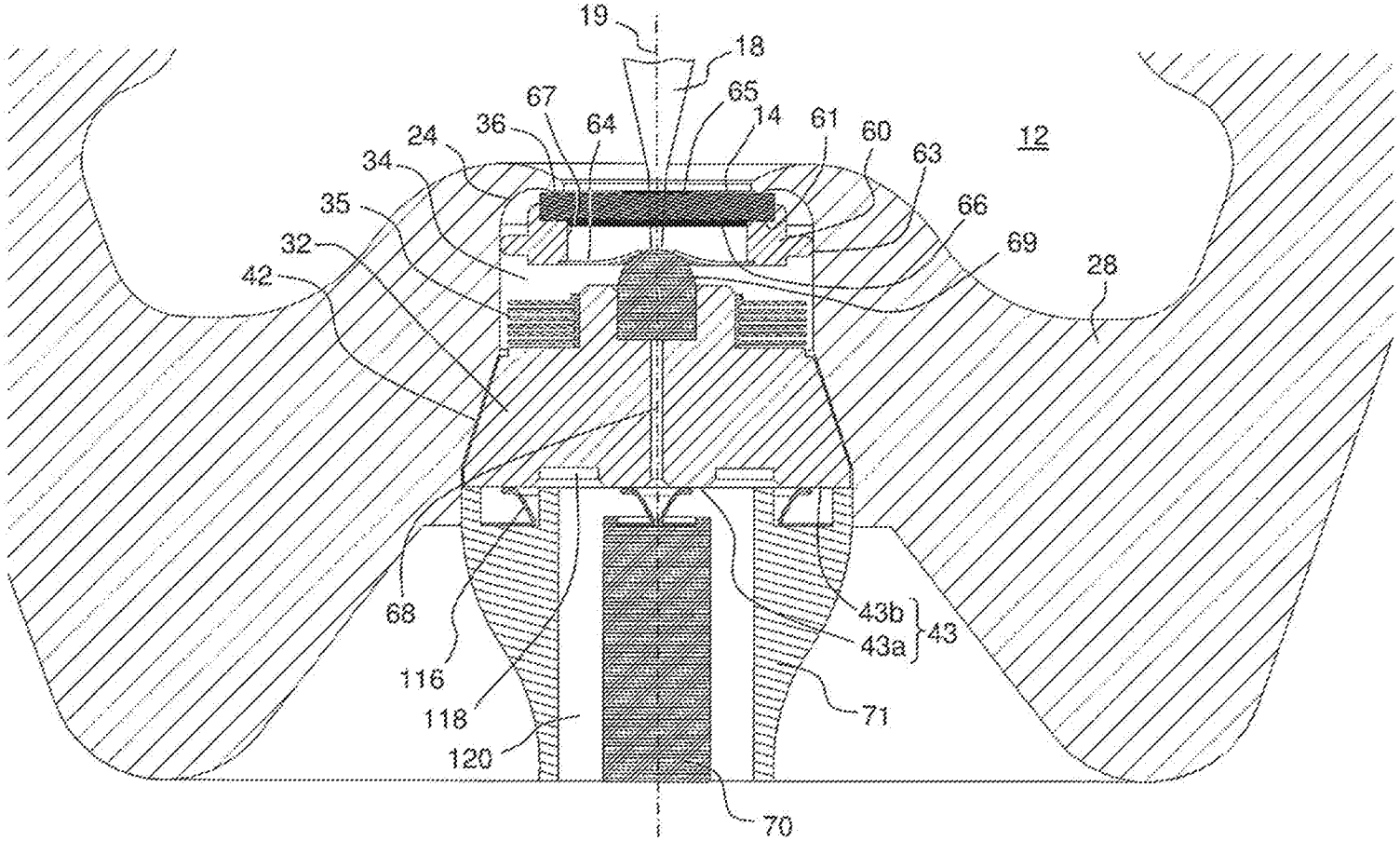
FIG. 3 is a partial and enlarged view of the source of FIG. 1 around its cathode.

FIG. 3 is a partial and enlarged view of the source 10 around the cathode 14. The cathode 14 is placed in the cavity 34 in abutment against the end 36 of the electrode 24. A holder 60 allows the cathode 14 to be centered with respect to the electrode 24. Since the electrode 24 is axisymmetric about the axis 19, the cathode 14 is therefore centered on the axis 19, allowing it to emit the electron beam 18 along the axis 19. The holder 60 comprises a counter bore 61 centered on the axis 19 and in which the cathode 14 is placed. On its periphery, the holder 60 comprises an annular zone 63 that is centered on the electrode 24. A spring 64 bears against the holder 60 so as to hold the cathode 14 in abutment against the electrode 24. The holder 60 is made of an insulator. The spring 64 may have an electrical function allowing a control signal to be conveyed to the cathode 14. More precisely, the cathode 14 emits the electron beam 18 via a face 65, called the front face, which is oriented in the direction of the anode 16. The cathode 14 is electrically controlled via its back face 66, i.e. its face opposite the front face 65. The holder 60 may comprise an aperture 67 of circular cross section centered on the axis 19. The aperture 67 may be metallized so as to electrically connect the spring 64 and the back face 66 of the cathode 14. The stopper 32 may allow means for controlling the cathode 14 to be electrically connected by way of a metallized via 68 passing therethrough and of a contact 69 that is securely fastened to the stopper 32. The contact 69 bears against the spring 64 along the axis 19 in order to keep the cathode 14 in abutment against the electrode 24. The contact 69 ensures an electrical continuity between the via 68 and the spring 64.

That surface 43 of the stopper 32 which is located on the exterior of the vacuum chamber 12 may be metallized in two separate zones: a zone 43*a* centered on the axis 19 and a peripheral annular zone 43*b* around the axis 19. The metallized zone 43*a* is in electrical continuity with the metallized via 68. The metallized zone 43*b* is in electrical continuity with the brazing film 42. A central contact 70 bears against the zone 43*a* and a peripheral contact 71 bears against the zone 43*b*. The two contacts 70 and 71 form a coaxial connector that electrically connects the cathode 14 and the electrode 24 by way of the metallized zones 43*a* and 43*b* and by way of the metallized via 68 and of the brazing film 42.

The cathode 14 may comprise a plurality of separate emitting zones that are separately addressable. The back face 66 then has a plurality of separate electrical contact zones. The holder 60 and the spring 64 are modified accordingly. A plurality of contacts similar to the contact 69 and a plurality of metallized vias similar to the via 68 allow the various zones of the back face 66 to be connected. The surface 43 of the stopper 32, the contact 69 and the spring 64 are partitioned accordingly in order to provide therein a plurality of zones similar to the zone 43*a* and in electrical continuity with each of the metallized vias.

At least one getter 35 may be placed in the cavity 34, between the cathode 14 and the stopper 32, in order to trap any particles liable to degrade the quality of the vacuum in the chamber 12. The getter 35 generally acts by chemisorption. Alloys based on zirconium or titanium may be employed to trap any particles emitted by the various components of the source 10 encircling the cavity 34. The getter 35 is, in the example shown, fastened to the stopper 32. The getter 35 is made up of ring-shaped discs that are stacked and that encircle the contact 69.

Figure 4B:
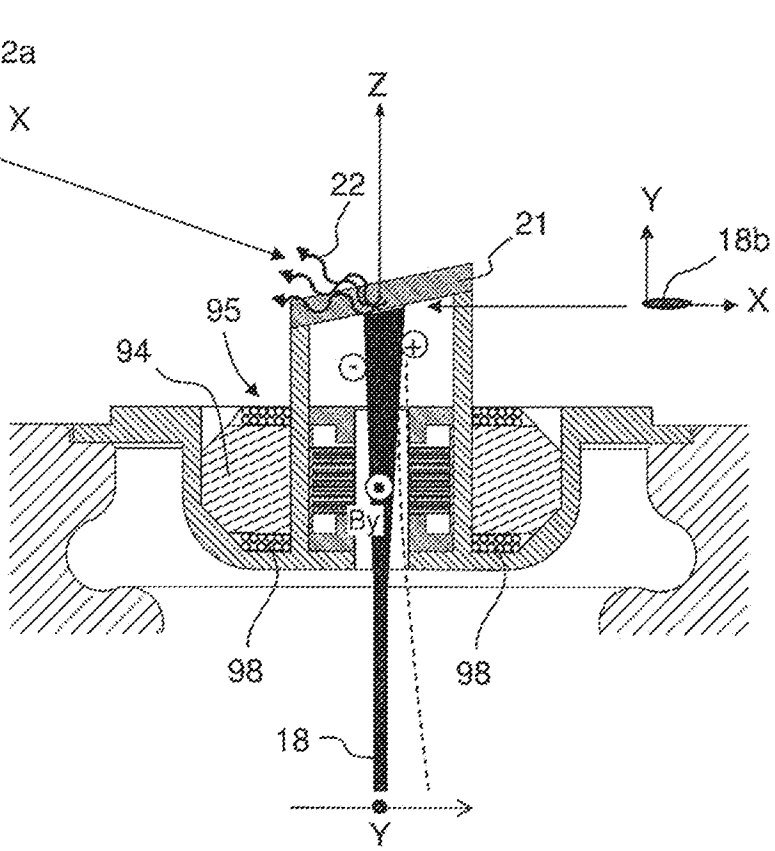
FIGS. 4*a* and 4*b* are partial and enlarged views of the source of FIG. 1 around its anode according to two variants.
Figure 4A:
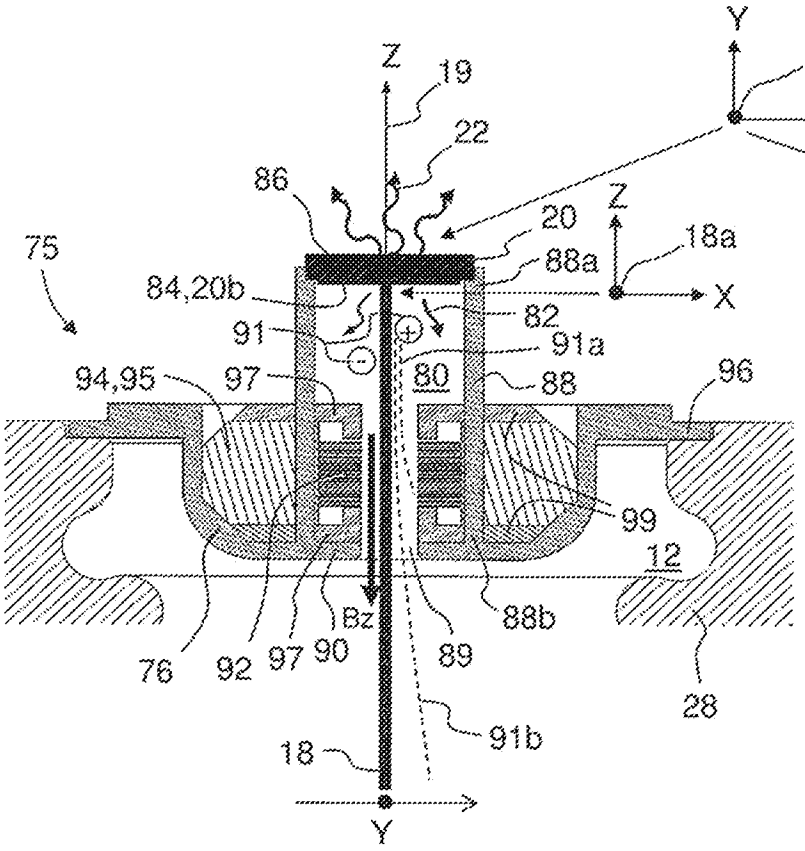

FIG. 4*a* shows a variant source 75 of ionizing radiation, in which source the anode 16 described above has been replaced with an anode 76. FIG. 4*a* is a partial and enlarged view of the source 75 around the anode 76. Just like the anode 16, the anode 76 comprises a target 20 that is bombarded by the beam 18 and that emits x-rays 22. Unlike the anode 16, the anode 76 comprises a cavity 80 into which the electron beam 18 penetrates to reach the target 20. More precisely, the electron beam 18 strikes the target 20 via its internal face 84 bearing the thin layer 20*b* and emits x-rays 22 via its external face 86. In the example shown, the walls of the cavity 80 have, around the axis 19, a cylindrical portion 88 extending between two ends 88*a* and 88*b*. The end 88*a* makes contact with the target 20 and the end 88*b* is closer to the cathode 14. The walls of the cavity 80 also have a ring-shaped portion 90 containing a hole 89 and closing the cylindrical portion at the end 88*b*. The electron beam 18 penetrates into the cavity 80 via the hole 89 in the portion 90.

During the bombardment of the target 20 by the electron beam 18, the increase in the temperature of the target 20 may lead to molecules degassing from the target 2, which, under the effect of the x-rays 22, are ionized. Ions 91 that appear at the interior face 84 of the target 20 may damage the cathode if they migrate in the accelerating electric field located between the anode and the cathode. Advantageously, the walls of the cavity 80 may be used to trap the ions 91.

To this end, the walls 88 and 90 of the cavity 80 are electrical conductors and form a faraday cage with respect to the parasitic ions that may be emitted by the target 20 into the interior of the vacuum chamber 12. The ions 91 possibly emitted by the target 20 into the interior of the vacuum chamber 12 are to a large extent trapped in the cavity 80. Only the hole 89 of the portion 90 allows these ions to exit from the cavity 80 and to then possibly be accelerated toward the cathode 14. To better trap the ions in the cavity 80, at least one getter 92 is placed in the cavity 80. The getter 92 is separate from the walls 88 and 90 of the cavity 80. The getter 92 is a specific component placed in the cavity 80. Just like the getter 35, the getter 92 generally acts by chemisorption. Alloys based on zirconium or titanium may be used to trap the emitted ions 91.

In addition to trapping ions, the walls of the cavity 80 may form a shielding screen with respect to parasitic ionizing radiation 82 generated in the interior of the vacuum chamber 12 and optionally an electrostatic shield with respect to the electric field generated between the cathode 14 and the anode 76. The x-rays 22 form the useful emission emitted by the source 75. However, parasitic x-rays may exit from the target 20 via the internal face 84. This parasitic emission is neither useful nor desirable. Conventionally, shielding screens that block this type of parasitic radiation are placed around x-ray generators. This type of embodiment however has a drawback. Specifically, the further the shielding screens are placed from the x-ray source, i.e. the further they are from the target, the larger the area of the screens must be because of their distance. This aspect of the invention proposes to place such screens as close as possible to the parasitic source, thereby allowing them to be miniaturized.

The anode 76 and in particular the walls of the cavity 80 are advantageously made from a material of high atomic number such as, for example, from an alloy based on tungsten or molybdenum, in order to stop the parasitic emission 82. Tungsten or molybdenum have almost no effect with respect to the trapping of parasitic ions. Producing the getter 92 separately from the walls of the cavity 80 allows the materials thereof to be freely chosen with a view to ensuring that the function of trapping parasitic ions performed by the getter 92 and the function of screening the parasitic emission 92 performed by the walls of the cavity 80 are both performed as well as possible without compromise therebetween. For this reason, the getter 92 and the walls of the cavity 80 are made from different materials each of which is suitable for the function that is assigned thereto. The same goes for the getter 35 with respect to the walls of the cavity 34.

The walls of the cavity 80 encircle the electron beam 18 in the vicinity of the target 20.

Advantageously, the walls of the cavity 80 form a portion of the vacuum chamber 12.

Advantageously, the walls of the cavity 80 are arranged coaxially to the axis 19 so as to be located about the axis 19 radially at a constant distance and therefore as close as possible to the parasitic radiation. At the end 88*a*, the cylindrical portion 88 may partially or completely encircle the target 20, thus preventing any parasitic x-rays from escaping from the target 20 radially with respect to the axis 19.

Thus, the anode 76 performs several functions: its electrical function, a faraday-cage function blocking parasitic ions that may be emitted by the target 20 into the interior of the vacuum chamber 12, a function of shielding against parasitic x-rays and, also, the function of a wall of the vacuum chamber 12. By performing several functions by means of a single mechanical part, in this case the anode 76, the compactness of the source 75 is increased and its weight decreased.

Moreover, it is possible to place, around the cavity 80, at least one magnet or electromagnet 94 allowing the electron beam 18 to be focused on the target 20. Advantageously, the magnet or electromagnet 94 may also be arranged so as to deviate parasitic ions 91 toward the one or more getters 92 in order to prevent these parasitic ions from exiting from the cavity via the hole 89 in the portion 90 or, at the very least, to deviate them with respect to the axis 19 passing through the cathode 14. To this end, the magnet or electromagnet 94 generates a magnetic field B that is oriented along the axis 19. In FIG. 4*a*, the ions 91 deviated toward the getter 92 follow a path 91*a* and the ions exiting the cavity 80 follow a path 91*b*.

The means for trapping the parasitic ions 91 that may be emitted by the target 20 are multiple: faraday cage formed by the walls of the cavity 80, presence of getters 92 in the cavity 80 and presence of a magnet or electromagnet 94 for deviating the parasitic ions. These means may be implemented independently or in addition to the function of shielding against parasitic x-rays and the function of a wall of the vacuum chamber 12.

The anode 76 advantageously takes the form of a one-piece mechanical part that is axisymmetric about the axis 19. The cavity 80 forms a central tubular portion of the anode 76. The magnet or electromagnet 94 is placed around the cavity 80 in an annular space 95 that is advantageously located outside of the vacuum chamber 12. In order to ensure the magnetic flux of the magnet or electromagnet 94 affects the electron beam 18 and the ions degassed by the target 20 into the interior of the chamber 12, the walls of the cavity 80 are made of an amagnetic material. More generally, the entire anode 76 is made, and for example machined, from the same material.

The getter 92 is located in the cavity 80 and the magnet or electromagnet 94 is located on the exterior of the cavity. Advantageously a mechanical holder 97 of the getter 92 holds the getter 92 and is made from a magnetic material. The holder 97 is placed in the cavity so as to guide the magnetic flux generated by the magnet or electromagnet 94. In the case of an electromagnet 94, it may be formed about a magnetic circuit 99. The holder 97 is advantageously placed in the extension of the magnetic circuit 99. The fact of using the mechanical holder 97 to perform two functions: holding the getter 92 and guiding a magnetic flux, allows the dimensions of the anode 76 and therefore of the source 75 to be further decreased.

On the periphery of the annular space 95, the anode comprises a zone 96 that bears against the mechanical part 28. This bearing zone 96 for example takes the form of a flat ring that extends perpendicularly to the axis 19.

In FIG. 4*a* an orthonormal coordinate system X, Y, Z has been defined. Z is the direction of the axis 19. The field Bz along the Z-axis allows the electron beam 18 to be focused on the target 20. The size of the electron spot 18*a* on the target 20 is shown in proximity to the target 20 in the XY plane. The electron spot 18*a* is circular. The size of the x-ray spot 22*a* emitted by the target 20 is also shown in proximity to the target 20 in the XY plane. Since the target 20 is perpendicular to the axis 19, the x-ray spot 22*a* is also circular.

FIG. 4*b* shows a variant of the anode 76, in which a target 21 is inclined with respect to the XY plane perpendicular to the axis 19. This inclination allows the area of the target 20 bombarded by the electron beam 18 to be enlarged. By enlarging this area, the increase in temperature of the target 20 due to the interaction with the electrons is better distributed. When the source 75 is employed for imaging, it is useful to preserve an x-ray spot 22*a* that is as point-like as possible or at the very least circular as in the variant of FIG. 4*a*. In order to preserve this spot 22*a*, with an inclined target 21, it is useful to modify the shape of the electron spot in the XY plane. In the variant of FIG. 4*b*, the electron spot has been referenced with the reference 18*b* and is shown in proximity to the target 21 in its XY plane. The spot is advantageously of elliptical shape. Such a spot shape may be obtained using cathode emitting zones that are distributed in the plane of the cathode in a shape similar to the shape desired for the spot 18*b*. Alternatively or in addition, it is possible to modify the shape of the cross section of the electron beam 18 by means of a magnetic field By oriented along the Y-axis and for example generated by a quadrupole magnet possessing windings 98 that are also located in the annular space 95. The quadrupole magnet forms an active magnetic system that generates a magnetic field transverse to the axis 19, allowing the shape expected for the electron spot 18*b* to be obtained. For example, for a target inclined with respect to the X-direction, the electron beam 18 is spread in the X-direction and is concentrated in the Y-direction in order to preserve a circular x-ray spot 22*a*. The active magnetic system may also be driven so as to obtain other electron-spot shapes and optionally other x-ray spot shapes. The active magnetic system is particularly advantageous when the target 21 is inclined. The active magnetic system may also be employed with a target 20 perpendicular to the axis 19.

It is possible to implement each and every variant of the anode 16 and 76 irrespectively of whether the electrode 24 takes the form of a conductive area placed on the concave face 26 of the dielectric and irrespectively of whether the stopper 32 is employed.

In the variants illustrated in FIGS. 1 to 4, all the components may be assembled by translation of each thereof along the same axis, in the present case the axis 19. This allows the production of a source according to the invention to be simplified by automating its manufacture.

More precisely, the mechanical part 28 made of dielectric and on which various metallizations have been produced, in particular the metallization forming the electrode 24, forms a monolithic holder. It is possible to assemble the cathode 14 and the stopper 32 on one side of this holder. On the other side of this holder, it is possible to assemble the anode 16 or 76. The anode 16 or 17 and the stopper 32 may be fastened to the mechanical part by ultra-high vacuum brazing. The target 20 or 21 may also be assembled with the anode 76 by translation along the axis 19.

Figure 5:
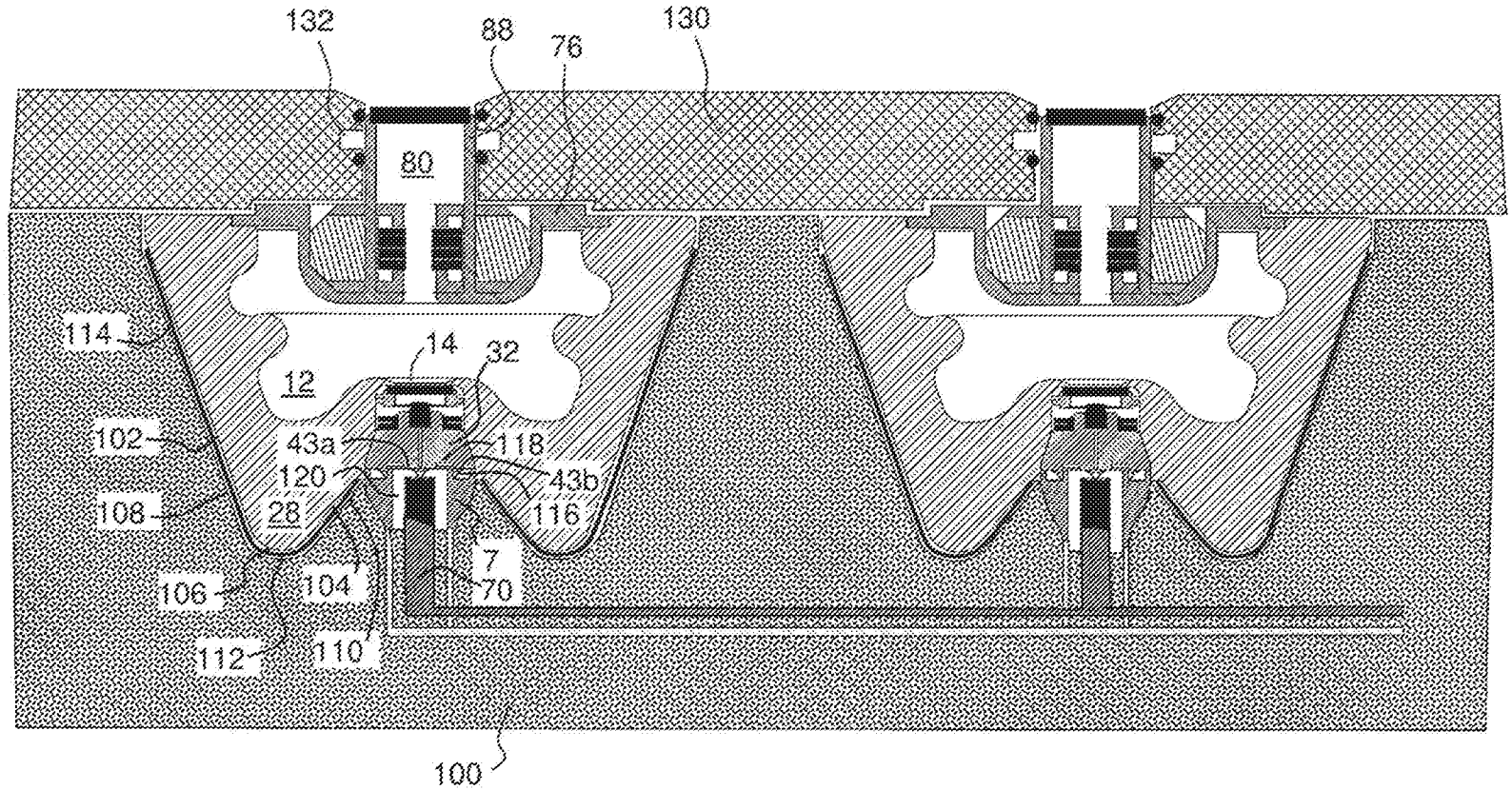
FIG. 5 shows in cross section a mode of integration comprising a plurality of sources according to the invention.

FIG. 5 shows two identical sources 75 mounted in the same holder 100. This type of mounting may be employed to mount more than two sources. This example also applies to the sources 10. Sources 10 such as shown in FIGS. 1 and 2 may also be mounted in the holder 100. The description of the holder 100 and of the complementary parts is still valid whatever the number of sources. The surface exterior to the vacuum chamber 12 of the mechanical part 28 advantageously comprises two frustoconical shapes 102 and 104 that extend about the axis 19. The shape 102 is an exterior conic frustum that flares towards the anode 16. The shape 104 is an interior conic frustum that flares from the cathode 14 and more precisely from the external face 43 of the stopper 32. The two conic frustums 102 and 104 meet on a crown 106 that is also centered on the axis 19. The crown 106 forms the smallest diameter of the conic frustum 102 and the largest diameter of the conic frustum 104. The crown 106 is for example the shape of a portion of a torus, allowing the two conic frustums 102 and 104 to be connected without sharp edges. The shape of the exterior surface of the mechanical part 28 facilitates placement of the source 75 in the holder 100, which has a complementary surface also comprising two frustoconical shapes 108 and 110. The conic frustum 108 of the holder 100 is complementary to the conic frustum 102 of the mechanical part 28. Likewise, the conic frustum 110 of the holder 100 is complementary to the conic frustum 104 of the mechanical part 28. The holder 100 has a crown 112 that is complementary to the crown 106 of the mechanical part 28.

In order to prevent any air-filled cavity forming at the high-voltage interface between the holder 100 and the mechanical part 28, a supple seal 114 that is for example based on silicone is placed between the holder 100 and the mechanical part 28, and more precisely between the complementary conic frustums and crowns. Advantageously, the conic frustum 108 of the holder 100 has an angle at the apex that is more open than that of the conic frustum 102 of the mechanical part 28. Likewise, the conic frustum 110 of the holder 100 has an angle at the apex that is more open than that of the conic frustum 104 of the mechanical part 28. The difference in angular value at the apex between the conic frustums may be smaller than 1 degree and for example about 0.5 degrees. Thus, when the source 75 is mounted in its holder 100, and more precisely when the seal 114 is crushed between the holder 100 and the mechanical part 28, air may escape from the interface between the crowns 106 and 112 on the one hand toward the more flared portion of the two conic frustums 102 and 108 in the direction of the anode 16 and on the other hand toward the narrower portion of the two conic frustums 104 and 110 in the direction of the cathode 14 and more precisely in the direction of the stopper 32. The air located between the two conic frustums 102 and 108 escapes to the ambient environment and the air located between the two conic frustums 104 and 110 escapes to the stopper 32. In order to prevent the trapped air from being subjected to a high electric field, the source 75 and its holder 100 are configured so that the air located between the two conic frustums 104 and 110 escapes into the interior of the coaxial link formed by the two contacts 70 and 71 and supplying the cathode 14. To achieve this, the exterior contact 71 ensuring the supply of the electrode 24 makes contact with the metallized zone 43*b* by means of a spring 116 allowing a functional play between the contact 71 and the stopper 32. In addition, the stopper 32 may comprise an annular groove 118 separating the two metallized zones 43*a* and 43*b*. Thus, air escaping from between the conic frustums 104 and 110 passes through the functional play between the contact 71 and the stopper 32 to reach a cavity 120 located between the contacts 70 and 71. This cavity 120 is protected from the high electric field because it is located in the interior of the coaxial contact 71. In other words, the cavity 120 is shielded from the main electric field of the source 10, i.e. the electric field due to the potential difference between the anode 16 and the cathodic electrode 24.

After the mechanical part 28 equipped with its cathode 14 and its anode 76 has been mounted, a closing plate 130 may hold the mechanical part 28, equipped with its cathode 14 and its anode 76, in the holder 100. The plate 130 may be made of a conductive material or comprise a metallized face in order to ensure the electrical connection of the anode 76. The plate 130 may allow the anode 76 to be cooled. This cooling may be achieved by conduction by means of a contact between the anode 76 and for example the cylindrical portion 88 of the cavity 80 of the anode 76. To reinforce this cooling, it is possible to make provision for a channel 132 in the plate 130 and encircling the cylindrical portion 88. A heat-transfer fluid flows through the channel 132 in order to cool the anode 76.

Figure 6A:
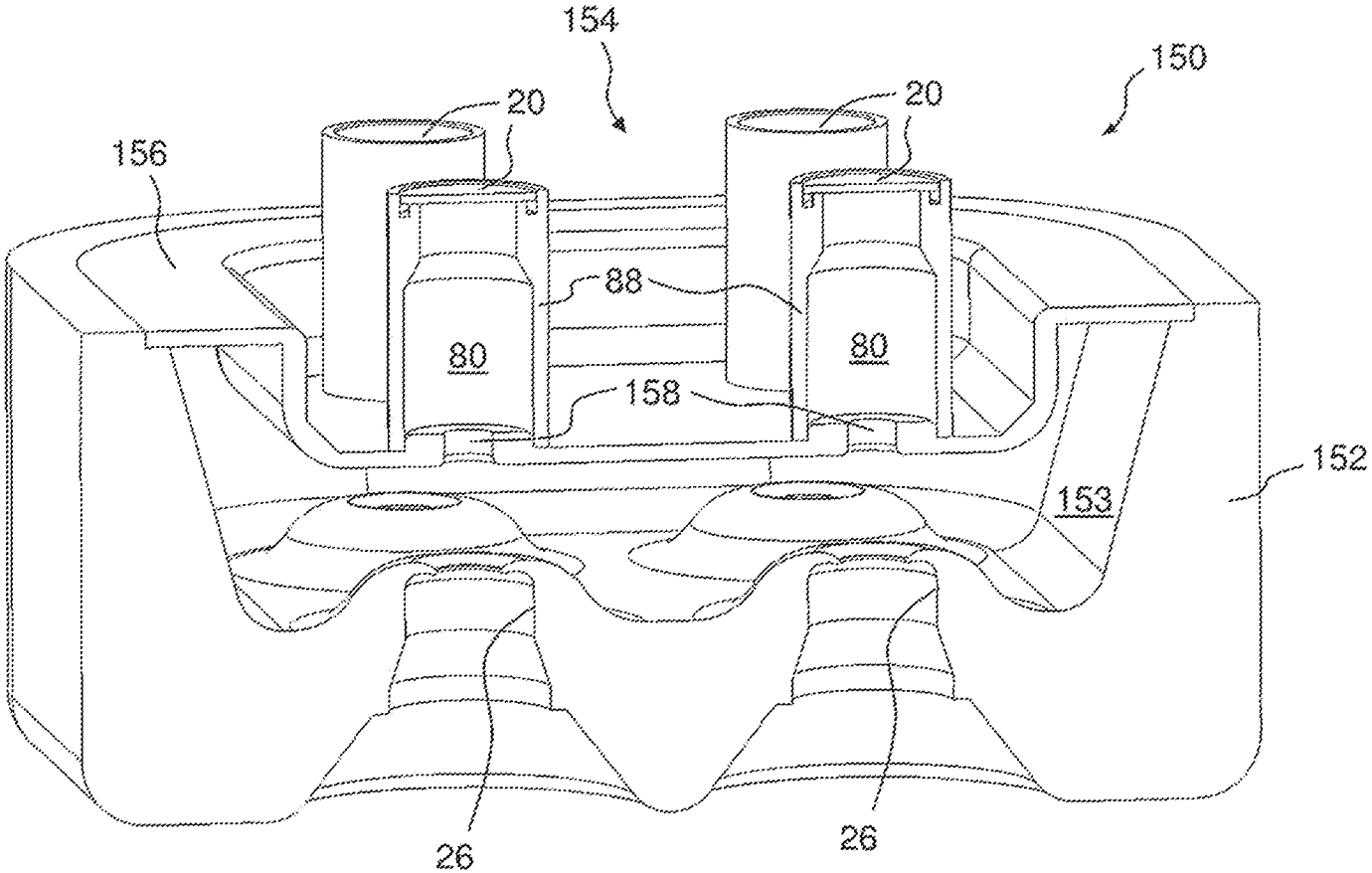
FIGS. 6*a*, 6*b*, 6*c*, 6*d* and 6*e* show variants of an assembly comprising a plurality of sources in the same vacuum chamber.

In FIG. 5, the sources 75 all possess separate mechanical parts 28. FIG. 6*a* shows a variant of a multi-source assembly 150 in which a mechanical part 152 common to a plurality of sources 75, four in the example shown, performs all the functions of the mechanical part 28. The vacuum chamber 153 is common to the various sources 75. The holder 152 is advantageously made of a dielectric in which, for each of these sources 75, a concave face 26 is produced. For each of the sources, an electrode 24 (not shown) is placed on the corresponding concave face 26. In order not to overload the figure, the cathodes 14 of the various sources 75 have not been shown.

In the variant of FIG. 6*a*, the anodes of all the sources 75 are advantageously common and together have been given the reference 154. To facilitate production thereof, the anodes comprise a plate 156 making contact with the mechanical part 152 and drilled with 4 holes 158 each allowing an electron beam 18 generated by each one of the cathodes of the sources 75 to pass. The plate 156 performs, for each of the sources 75, the function of the portion 90 described above. A cavity 80 bounded by its wall 88 and a target 20 is placed above each orifice 158. Alternatively, it is possible to preserve separate anodes, thereby allowing their electrical connection to be disassociated.

Figure 6B:
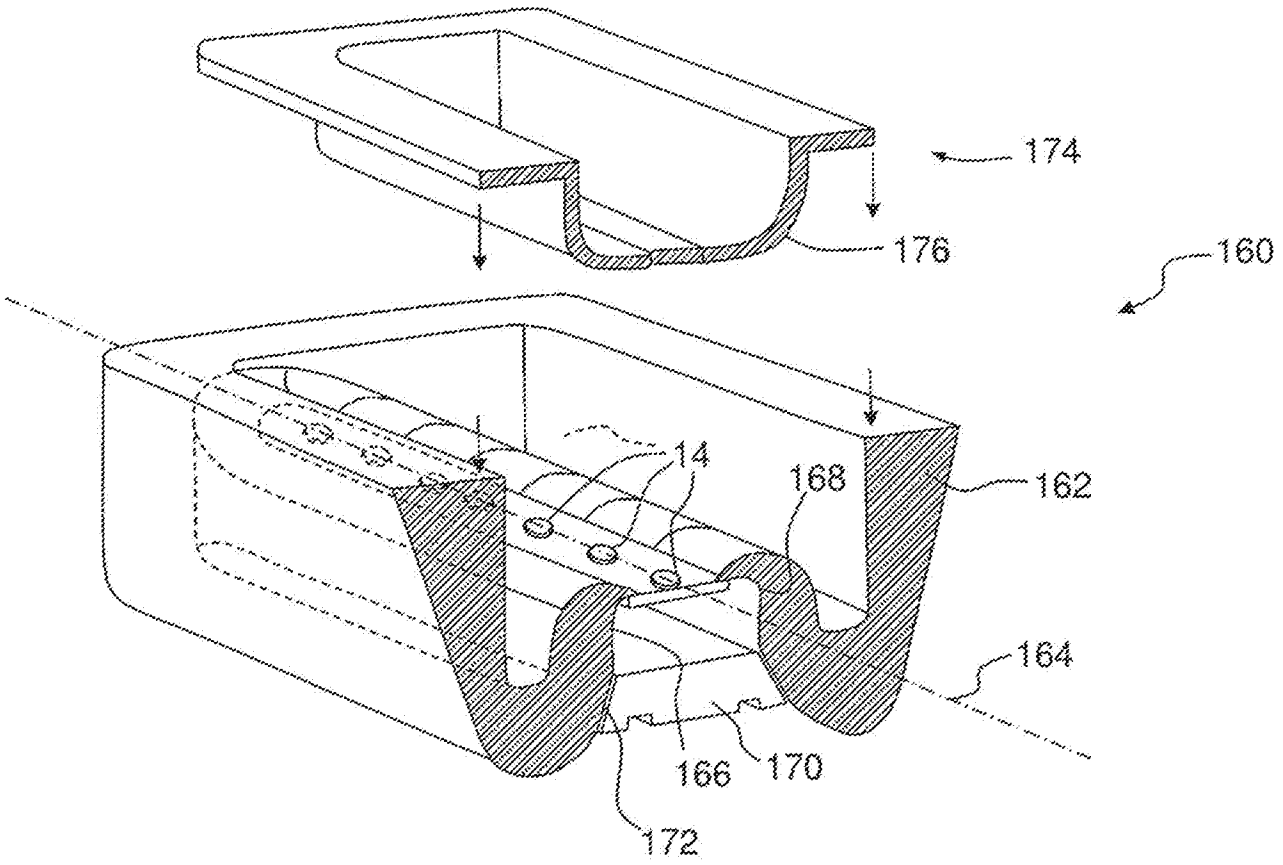

FIG. 6*b* shows another variant of a multi-source assembly 160 in which a mechanical part 162 is also common to a plurality of sources the respective cathodes 14 of which are aligned on an axis 164 passing through each of the cathodes 14. The axis 164 is perpendicular to the axis 19 of each of these sources. An electrode 166 allowing the electron beams emitted by the various cathodes 14 to be focused is common to all the cathodes 14. The variant of FIG. 6*b* allows the distance separating two neighboring sources to be further decreased.

In the example shown, the mechanical part 162 is made of dielectric and comprises a concave face 168 that is placed in the vicinity of the various cathodes 14. The electrode 166 is formed from a conductive area placed on the concave face 168. The electrode 166 performs all the functions of the electrode 24 described above.

Alternatively, it is possible for the electrode that is common to a plurality of sources to take the form of a metal electrode that is not associated with a dielectric, i.e. that possesses a metal/vacuum interface. Likewise, the cathodes may be thermionic. In this embodiment, the common metal electrode forms the holder of the various cathodes of the various sources. Since this electrode is large in size, it is advantageous to connect it to the ground of the generator of the multi-source assembly. The one or more anodes are then connected to one or more positive potentials of the generator.

The multi-source assembly 160 may comprise a stopper 170 that is common to all the sources. The stopper 170 may perform all the functions of the stopper 32 described above. The stopper 170 may in particular be fastened to the mechanical part 162 by means of a conductive brazing film 172 used to electrically connect the electrode 166.

As in the variant of FIG. 6*a*, the multi-source assembly 160 may comprise an anode 174 that is common to the various sources. The anode 174 is similar to the anode 154 of the variant of FIG. 6*a*. The anode 174 comprises a plate 176 performing all the functions of the plate 156 described with reference to FIG. 6*a*. To avoid overcharging FIG. 6*b*, for the anode 174, only the plate 176 has been shown.

Figure 6C:
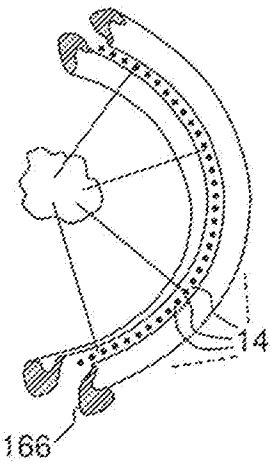

In FIG. 6*b*, the axis 164 is rectilinear. It is also possible to place the cathodes on a curved axis, such as for example a circular arc as shown in FIG. 6*c*, allowing the x-rays 22 of all the sources to be focused on a point located at the center of the circular arc. Curved axes of other shapes, in particular of parabolic shape, also allow x-rays to be focused on a point. The curved axis remains locally perpendicular to each of the axes 19 about which the electron beam of each source is generated.

Figure 6D:
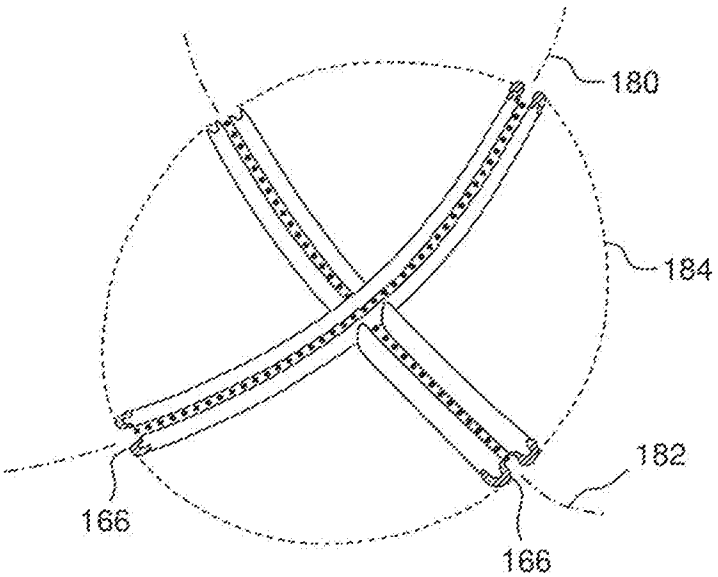
Figure 6E:
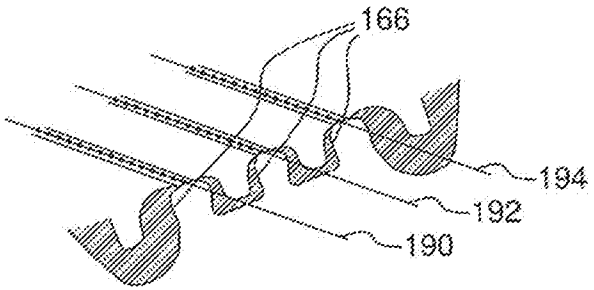

The arrangement of the cathodes 14 on an axis allows sources distributed in one direction to be obtained. It is also possible to produce a multi-source assembly in which the cathodes are distributed along a plurality of concurrent axes. It is for example possible to place the sources along a plurality of curved axes, each located in one plane, the planes being secant. By way of example, as shown in FIG. 6*d*, it is for example possible to make provision for a plurality of axes 180 and 182 that are distributed over a parabolic surface of revolution 184. This allows the x-rays 22 of all the sources to be focused on the focal point of the parabolic surface. In FIG. 6*e*, the various axes 190, 192 and 194 along which the various cathodes 14 of the multi-source assembly are distributed are parallel to one another.

Figure 7A:
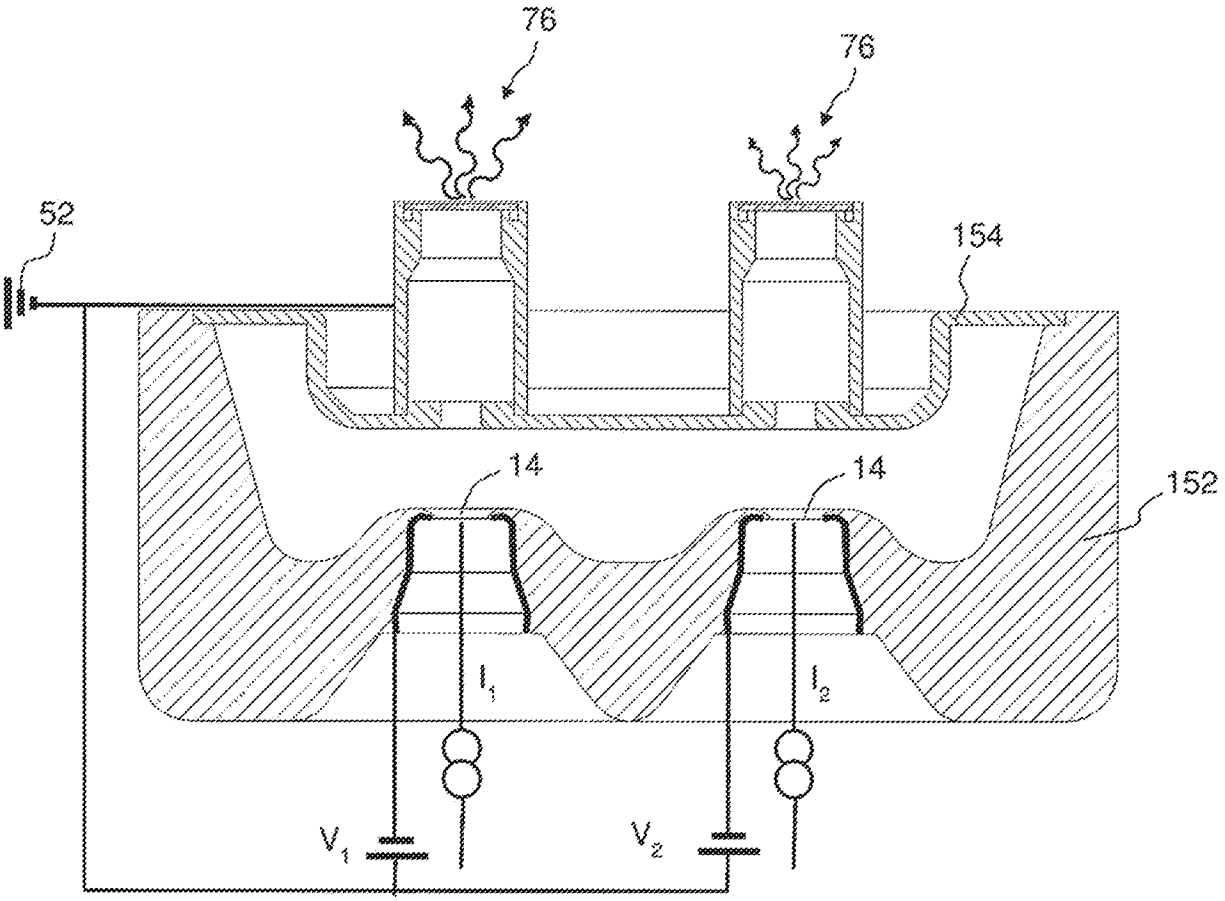
FIGS. 7*a* and 7*b* show a plurality of modes of electrical connection of an assembly comprising a plurality of sources.
Figure 7B:
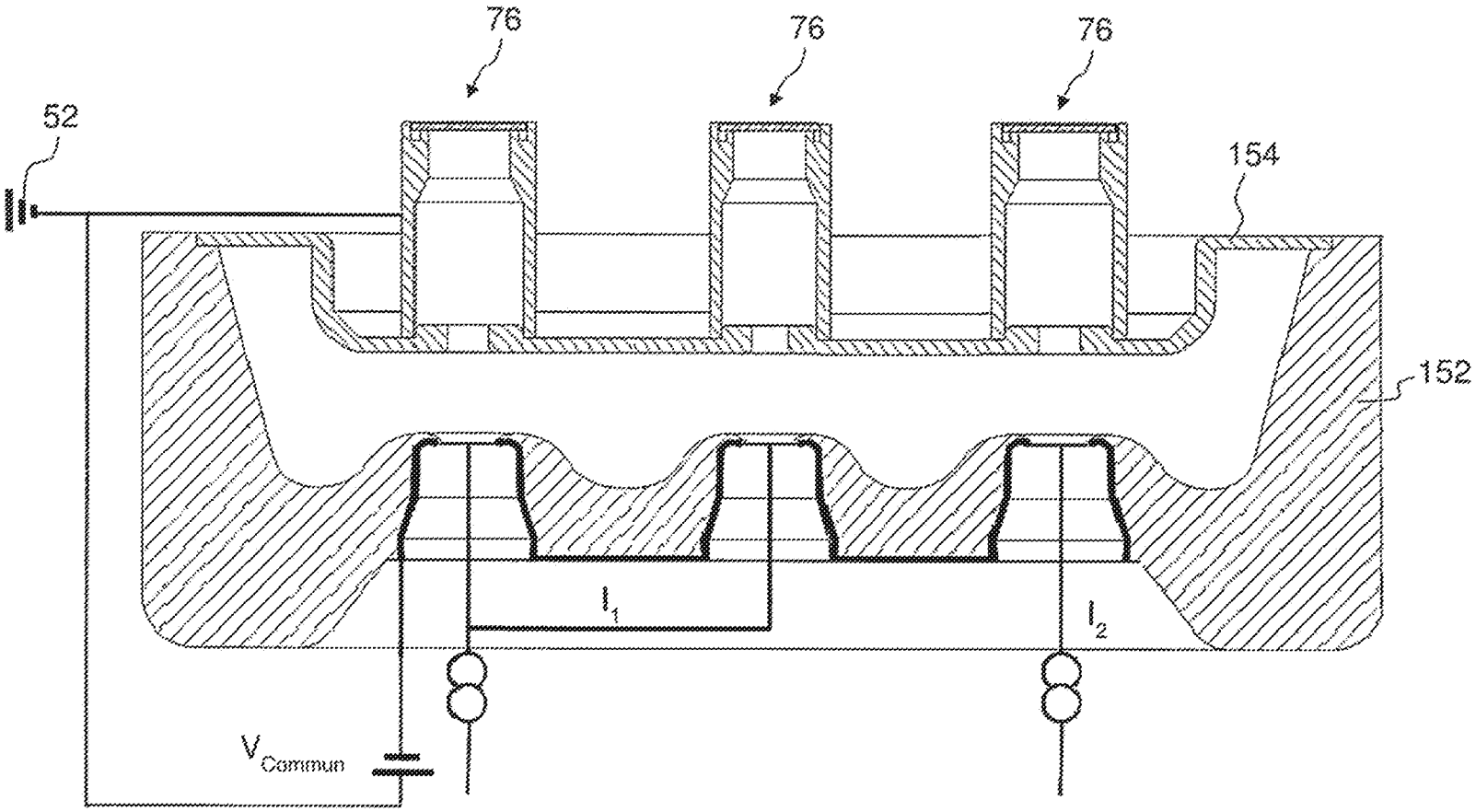

FIGS. 7*a* and 7*b* show two embodiments of the electrical supply of the assembly shown in FIG. 6*a*. FIGS. 7*a* and 7*b* are cross sections cut in a plane passing through a plurality of axes 19 of various sources 75. Two sources are shown in FIG. 7*a*, and three sources are shown in FIG. 7*b*. Of course, the description of the multi-source assembly 150 is valid whatever the number of sources 75 or optionally 10.

In these two embodiments, the anodes 114 are common to all the sources 75 of the assembly 150 and their potential is the same, for example that of the ground 52. In both embodiments, each of the sources 10 may be driven separately. In FIG. 7*a*, two high-voltage sources V1 and V2 separately supply the electrodes 24 of each of the sources 10. The insulating nature of the mechanical part 152 allows the two high-voltage sources V1 and V2, which may for example be pulsed at two different energies, to be separated. Likewise, separate current sources 11 and 12 each allow one of the various cathodes 14 to be controlled.

In the embodiment of FIG. 7*b*, the electrodes 24 of all the sources 75 are connected together for example by means of a metallization produced on the mechanical part 152. A high-voltage source $V_{Commun}$ supplies all the electrodes 24. The various cathodes 14 are still controlled via separate current sources 11 and 12. The electrical supply of the multi-source assembly described with reference to FIG. 7*b* is very suitable for the variant described with reference to FIGS. 6*b*, 6*d* and 6*e*.

Figure 8C:
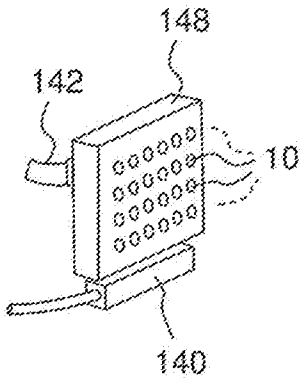
FIGS. 8*a*, 8*b* and 8*c* show three examples of assemblies comprising a plurality of sources according to the invention and able to be produced according to the variants illustrated in FIGS. 5 and 6.
Figure 8B:
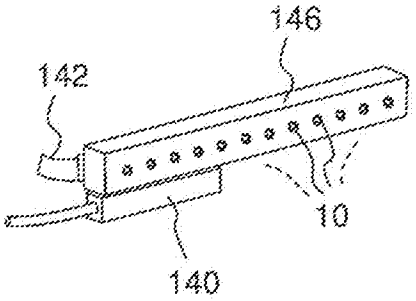
Figure 8A:
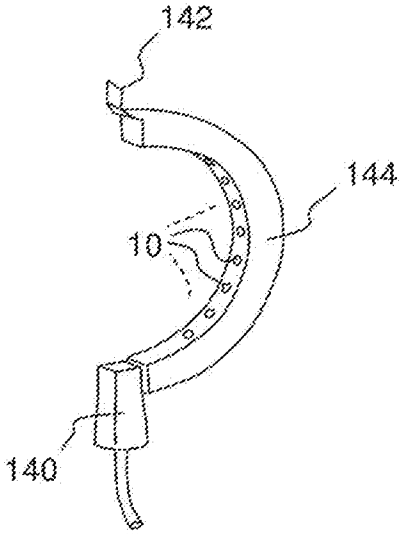

FIGS. 8*a*, 8*b* and 8*c* show a plurality of examples of assemblies for generating ionizing radiation each comprising a plurality of sources 10 or 75. In these various examples, the holder, such as described with reference to FIG. 5, is common to all the sources 10. A high-voltage connector 140 allows the various sources 10 to be supplied with power. A driver connector 142 allows each of the assemblies to be connected to a driving module (not shown) that is configured to switch each of these sources 10 in a preset sequence.

In FIG. 8*a*, the holder 144 has a circularly arcuate shape and the various sources 10 are aligned on the circularly arcuate shape. This type of arrangement is for example useful in a medical scanner, in order to avoid having to move the x-ray source around the patient. The various sources 10 each emit x-rays in turn. The scanner also comprises a radiation detector and a module allowing a three-dimensional image to be reconstructed from the information captured by the detector. In order not to overload the figure, the detector and the reconstructing model have not been shown. In FIG. 8*b*, the holder 146 and the sources 10 are aligned on a straight-line segment. In FIG. 8*c*, the holder 148 has a plate shape and the sources are distributed in two directions over the holder 148. For the assemblies for generating ionizing radiation shown in FIGS. 8*a* and 8*b*, the variant of FIG. 6*b* is particularly advantageous. This variant allows the pitch between the various sources to be decreased.

The invention claimed is:

1. A source for generating x-ray radiation, comprising:

a vacuum chamber;

a cathode that is able to emit an electron beam into the chamber;

an anode that receives the electron beam and that comprises a target that is able to generate x-ray radiation from the energy received from the electron beam;

an electrode that is placed in the vicinity of the cathode and that allows the electron beam to be focused; and a stopper ensuring the seal tightness of the vacuum chamber;

wherein the source comprises a mechanical part that is made of dielectric and that forms a portion of the vacuum chamber, and the stopper is fastened to the mechanical part by a conductive brazing film that is used to electrically connect the electrode.

2. The source according to claim 1, wherein the stopper is made from the same dielectric as the mechanical part.

3. The source according to claim 1, wherein the brazing film is axisymmetric about an axis of the electron beam and the brazing film forms with the electrode an equipotential assembly.

4. The source according to claim 1, wherein the stopper comprises at least one electrical connection passing therethrough, allowing a means for controlling the cathode to be electrically connected, and biased to a different potential to the brazing film.

5. The source according to claim 4, wherein the stopper forms a coaxial transmission line, the electrical connection passing through the stopper forming a central conductor of the coaxial line and the brazing film of the stopper forming a shield of the coaxial line.

6. The source according to claim 4, wherein the stopper comprises a surface exterior to the vacuum chamber, in that the exterior surface comprises a plurality of separate zones that are metallized separately, in that at least one of these zones makes electrical contact with the at least one electrical connection and in that another of these zones makes electrical contact with the brazing film, in order to ensure the electrical connection of the cathode and of the electrode by way of the at least one electrical connection and of the brazing film.

7. The source according to claim 6, wherein the mechanical part comprises a surface exterior to the vacuum chamber having an interior frustoconical shape that flares from the external surface of the stopper, the source further comprising a holder having a surface that is complementary to the interior frustoconical shape of the mechanical part and the complementary surface and the interior frustoconical shape are configured to convey air trapped between the complementary surface and the interior frustoconical shape when the mechanical part is mounted in the holder toward the cavity.

8. The source according to claim 4, further comprising a coaxial connector connected to the brazing film and to the at least one electrical connection, and a cavity located between the coaxial connector and the stopper, the cavity being shielded from a main electric field of the source.

9. The source according to claim 4, wherein the cathode emits the electron beam via a field effect and in that the means for controlling the cathode comprise an optoelectronic component that is electrically connected via the electrical connection passing through the stopper.

10. The source according to claim 1, wherein the mechanical part comprises a cavity in which the cathode is placed and a getter is placed in the cavity, between the cathode and the stopper.

* * * * *